US009868225B2

(12) United States Patent
Douglas et al.

(10) Patent No.: US 9,868,225 B2
(45) Date of Patent: Jan. 16, 2018

(54) STABILIZING A CONCRETE FORM

(71) Applicant: James Julian Douglas, St. Inigoes, MD (US)

(72) Inventors: James Julian Douglas, St. Inigoes, MD (US); Carl J. Hopson, Solomons, MD (US)

( * ) Notice: Subject to any disclaimer, the term of this patent is extended or adjusted under 35 U.S.C. 154(b) by 0 days.

(21) Appl. No.: 15/472,383

(22) Filed: Mar. 29, 2017

(65) Prior Publication Data

US 2017/0320235 A1 Nov. 9, 2017

Related U.S. Application Data

(60) Provisional application No. 62/316,637, filed on Apr. 1, 2016.

(51) Int. Cl.

| | |
|---|---|
| ***E04G 17/14*** | (2006.01) |
| ***E04G 25/04*** | (2006.01) |
| ***B28B 23/00*** | (2006.01) |
| ***B28B 3/26*** | (2006.01) |
| ***B28B 1/00*** | (2006.01) |

(Continued)

(52) U.S. Cl.

CPC ..... *B28B 23/005* (2013.01); *B28B 1/002* (2013.01); *B28B 3/2645* (2013.01); *B28B 23/026* (2013.01); *E04G 17/14* (2013.01); *B28B 1/266* (2013.01); *B28B 1/30* (2013.01); *B28B 2003/203* (2013.01); *E04G 25/04* (2013.01)

(58) Field of Classification Search

CPC ..... E04G 2017/008; E04G 9/08; E04G 17/14; E04G 25/04; E04G 25/06; E04G 25/08

See application file for complete search history.

(56) References Cited

U.S. PATENT DOCUMENTS 2,511,584 A * 6/1950 Hill ..... E04G 11/10 249/192
2,725,210 A * 11/1955 Swartz ..... E04G 25/06 248/354.3

(Continued)

FOREIGN PATENT DOCUMENTS

EP 1106748 A2 * 6/2001 ..... E04G 17/14

OTHER PUBLICATIONS http://www.adjustablekicker.com/, website Nov. 9, 2000 via web.archive.org.

*Primary Examiner* — Rodney Mintz
(74) *Attorney, Agent, or Firm* — Leveque IP Law, P.C.

(57) ABSTRACT

A device for stabilizing a concrete form includes an anchoring member with a channel aligned along a first axis, and elongate members with cavities aligned along a second axis, the elongate members coupled to form a frame. The device may include an anchoring post for insertion through the channel of the anchoring member to secure the device to a surface, and sliders with elongate bodies for insertion into the cavities of the elongate members, where the sliders are affixed to an engagement member structurally configured for engaging the concrete form. First retaining members may be structurally configured to engage the anchoring post when inserted through the channel of the anchoring member thereby maintaining a position of the frame along the first axis. Second retaining members may be structurally configured to engage a slider when inserted into the elongate member thereby maintaining a position of the slider along the second axis.

28 Claims, 10 Drawing Sheets

(51) Int. Cl.

| | |
|---|---|
| ***B28B 23/02*** | (2006.01) |
| *B28B 3/20* | (2006.01) |
| *B28B 1/30* | (2006.01) |
| *B28B 1/26* | (2006.01) |

(56) References Cited

U.S. PATENT DOCUMENTS 2,764,798 A * 10/1956 Huff ..... E01C 19/506 249/208
2,945,662 A * 7/1960 Jennings ..... E04G 17/14 248/354.3
3,154,833 A * 11/1964 Kimball ..... E04G 9/10 211/186
3,785,606 A * 1/1974 Green ..... E01C 19/502 249/170
4,123,031 A * 10/1978 Hyre ..... E01D 21/00 14/77.1
4,342,440 A * 8/1982 Eyden ..... E04G 17/16 249/187.1
5,076,536 A * 12/1991 Fitzgerald ..... E01C 19/502 249/208
5,343,667 A * 9/1994 Peden ..... E04G 17/06 249/219.1
5,817,247 A 10/1998 Colatruglio
6,539,677 B1 * 4/2003 Lanka ..... E04G 17/002 248/354.3
6,752,570 B2 * 6/2004 Lanka ..... E04G 21/26 405/272
6,866,239 B2 * 3/2005 Miller ..... E01C 19/502 249/13
7,255,319 B2 * 8/2007 Albano ..... E04G 13/00 249/34
8,651,450 B2 * 2/2014 Sollars ..... E04G 13/00 249/194
8,733,728 B2 * 5/2014 Reilly ..... E04G 17/14 249/219.1
9,051,745 B1 * 6/2015 Parr ..... E04G 9/08
9,340,933 B2 * 5/2016 Parr ..... E01C 19/502
2004/0093817 A1 * 5/2004 Pujol Barcons ..... E02D 27/01 52/294
2008/0067308 A1 * 3/2008 Jones ..... E04G 13/00 248/220.21
2008/0265128 A1 * 10/2008 Hughes ..... E04G 13/00 249/190
2010/0012427 A1 * 1/2010 Julliard ..... A62B 1/04 182/82
2010/0218438 A1 * 9/2010 Sollars ..... E04G 13/00 52/127.2
2011/0285044 A1 * 11/2011 Sollars ..... E04G 13/00 264/31
2015/0136943 A1 * 5/2015 Parr ..... E04G 9/08 249/191
2015/0252576 A1 * 9/2015 Parr ..... E01C 19/502 249/191
2016/0130825 A1 * 5/2016 Hogan ..... E04G 13/00 264/31

* cited by examiner

STABILIZING A CONCRETE FORM

CROSS-REFERENCE TO RELATED APPLICATIONS

This application claims the benefit under 35 U.S.C. § 119(e) of U.S. Provisional Patent Application No. 62/316,637 filed on Apr. 1, 2016, the entire content of which is hereby incorporated by reference.

BACKGROUND

A concrete slab is a common structural element in buildings, where slabs of steel-reinforced concrete, e.g., between about 4 and about 20 inches thick, are used to construct floors and ceilings in buildings. For example, in many domestic and industrial buildings, a thick concrete slab (e.g., supported on foundations or directly on the subsoil) is used to construct the ground floor of a building. Thinner slabs of concrete (e.g., between about 2 and about 6 inches) may be used for exterior pavings and the like. Also, in high-rise buildings and skyscrapers, thinner concrete slabs may form the floors and ceilings on each level.

A concrete slab may be prefabricated or poured in situ. In situ concrete slabs are typically built on a construction site using formwork (also referred to herein as a "concrete form"), which may include a type of boxing or framing into which wet concrete is poured. If a concrete slab is to be reinforced, reinforcing bars (commonly referred to as "rebars") may be positioned within the formwork before the concrete is poured. Plastic tipped metal, or plastic bar chairs may be used to hold the rebar away from the bottom and sides of the formwork, so that, when the concrete sets, the concrete completely envelops the reinforcements. For a ground slab, the formwork may include sidewalls pushed into the ground or otherwise braced/supported. For a suspended slab, the formwork may be shaped like a tray, often supported by a temporary scaffold or the like until the concrete sets. The concrete form may be built using wooden planks and boards, plastic, steel, and the like.

The concrete form may use "kickers" or the like to hold the form in place, i.e., to stabilize or brace the concrete form. Kickers may include a wood block or board that is attached to the outside of a formwork member in a concrete form to provide stability to the structure. In formwork, a kicker may act as a haunch to take the thrust of another member. Kickers are often used once, or a relatively limited number of times, and then discarded. And because kickers often include wooden blocks or boards that could have otherwise been used in construction, discarding kickers after one use may waste valuable building material.

There remains a need for improved devices, systems, and methods for stabilizing a concrete form or other structure.

BRIEF DESCRIPTION OF THE DRAWINGS

The accompanying drawings provide visual representations which will be used to more fully describe various representative embodiments and can be used by those skilled in the art to better understand the representative embodiments disclosed and their inherent advantages. The drawings are not necessarily to scale, emphasis instead being placed upon illustrating the principles of the devices, systems, and methods described herein. In these drawings, like reference numerals identify corresponding elements.

DETAILED DESCRIPTION

Figure 1:
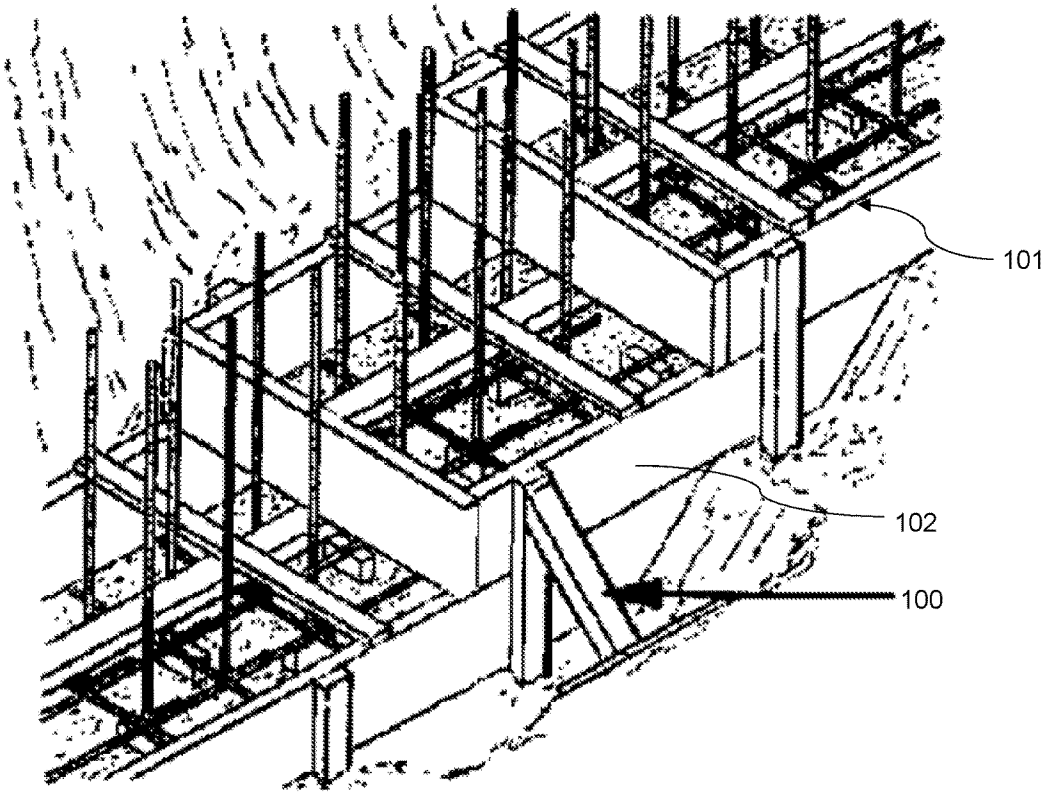
FIG. 1 (prior art)
FIG. 1 illustrates a kicker of the prior art.

The various methods, systems, apparatuses, and devices described herein generally provide for stabilizing a concrete form or other similar structure.

While the teachings are susceptible of embodiment in many different forms, there is shown in the drawings and will herein be described in detail specific embodiments, with the understanding that the present disclosure is to be considered as an example of the principles of the teachings and not intended to limit the teachings to the specific embodiments shown and described. In the description below, like reference numerals are used to describe the same, similar or corresponding parts in the several views of the drawings.

In this document, relational terms such as first and second, top and bottom, and the like may be used solely to distinguish one entity or action from another entity or action without necessarily requiring or implying any actual such relationship or order between such entities or actions. The terms "comprises," "comprising," "includes," "including," "has," "having," or any other variations thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

Reference throughout this document to "one embodiment," "certain embodiments," "an embodiment," "implementation(s)," "aspect(s)," or similar terms means that a particular feature, structure, or characteristic described in connection with the embodiment is included in at least one embodiment of the present teachings. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means "any of the following: A; B; C; A and B; A and C; B and C; A, B and C." An exception to this definition will occur only when a combination of elements, functions, steps or acts are in some way inherently mutually exclusive. Also, grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

All documents mentioned herein are hereby incorporated by reference in their entirety. References to items in the singular should be understood to include items in the plural, and vice versa, unless explicitly stated otherwise or clear from the text.

Recitation of ranges of values herein are not intended to be limiting, referring instead individually to any and all values falling within the range, unless otherwise indicated, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments. No language in the specification should be construed as indicating any unclaimed element as essential to the practice of the embodiments.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The description is not to be considered as limited to the scope of the embodiments described herein.

In the following description, it is understood that terms such as "first," "second," "top," "bottom," "up," "down," "above," "below," and the like, are words of convenience and are not to be construed as limiting terms.

In general, the devices, systems, and methods described herein may be configured for stabilizing a concrete form or other similar structure. Thus, the devices, systems, and methods described herein may replace kickers, cleats, or other stabilizers used in the prior art for stabilizing concrete forms or other similar structures.

By way of background, FIG. 1 illustrates a kicker of the prior art. As shown in this figure, a prior art kicker 100 may include a block of wood or the like that braces a wall 102 or other structure or surface of a concrete form 101 along an exterior of the concrete form 101. The kicker 100 may be cut, sized, and shaped specifically for stabilizing a certain concrete form 101, where after it is used for stabilizing or supporting the particular concrete form, the kicker 100 is discarded as scrap material. Even if the kicker 100 is not discarded, it may be difficult to reuse the kicker 100 because the kicker 100 may not be adjustable or adaptable for use with other forms.

Figure 2:
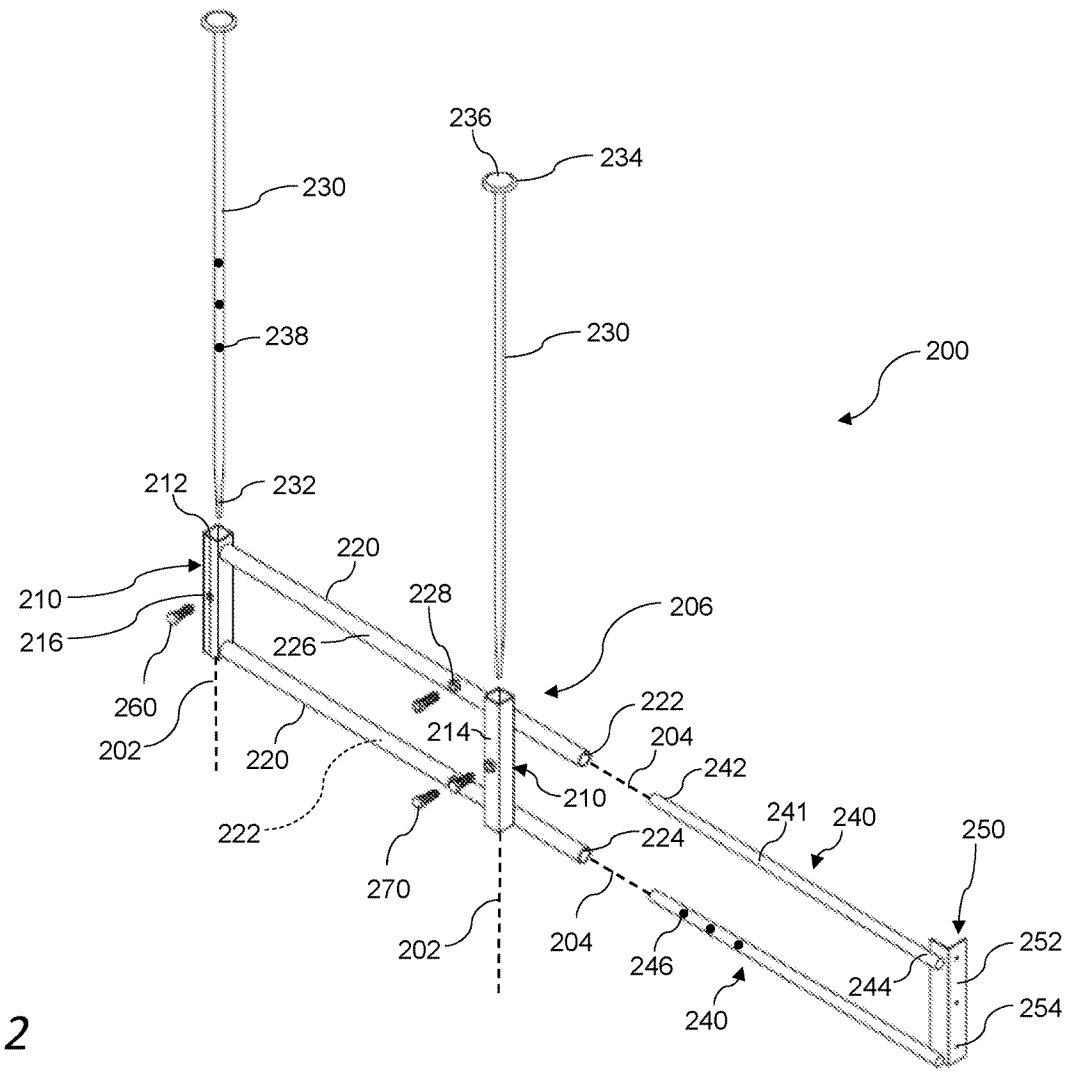
FIG. 2 illustrates an exploded view of a device for stabilizing a concrete form, in accordance with a representative embodiment.

FIG. 2 illustrates an exploded view of a device for stabilizing a concrete form, in accordance with a representative embodiment. The device 200 may be a reusable kicker or stabilizer for a concrete form or other similar structure. The device 200 may be adjustable, e.g., in at least two directions (e.g., along at least two axes or planes), and lockable in one or more positions or configurations. The device 200 may also or instead allow for a user to make relatively fine adjustments to its engagement to a concrete form after the device 200 is initially installed in place, e.g., adjusting the form in at least two directions.

The device 200 may include one or more anchoring members 210, one or more elongate members 220, one or more anchoring posts 230, one or more sliders 240, and one or more retaining members (e.g., a first retaining member 260 and a second retaining member 270).

As stated above, the device 200 may include one or more anchoring members 210. An anchoring member 210 may include a channel 212 defining a pathway therethrough aligned along a first axis 202. In certain implementations, e.g., as shown in the figure, the device 200 may include at least two anchoring members 210 each including a channel 212 defining a pathway therethrough aligned along the first axis 202, where the anchoring members 210 are disposed away from one another on the frame 206 with the pathway of each aligned substantially parallel to one another along the first axis 202. In an implementation, e.g., as shown in the figure, one or more of the anchoring members 210 may be formed by a shaft attached to each of two elongate members 220, e.g., a first elongate member and a second elongate member, where the channel 212 may be formed in a hollow core of the shaft.

The device 200 may include at least two elongate members 220, where each elongate member 220 includes a cavity 222. The elongate members 220 may be coupled to one another thereby forming a frame 206 for the device 200. For example, the elongate members 220 may be coupled by an anchoring member 210 or another structural component of the frame 206. The cavity 222 of one of the elongate members 220 may be aligned substantially parallel to the cavity 222 of another one of the elongate members 220 along a second axis 204, where the second axis 204 intersects the first axis 202. In certain implementations, the elongate members 220 may be disposed away from one another and aligned substantially parallel to one another along the second axis 204, e.g., where the second axis 204 is substantially perpendicular to the first axis 202.

In certain implementations, and as described above, at least two of the elongate members 220 are attached to an anchoring member 210, where the anchoring member 210 connects or couples the two elongate members 220. In alternate implementations, a portion of the frame 206 may couple the two elongate members 220. For example, the frame 206 may include a rounded end (see, e.g., FIG. 5) that couples the two elongate members 220.

The device 200 may include one or more anchoring posts 230. The anchoring posts 230 may be structurally configured for insertion through the channel 212 of one or more of the anchoring members 210 to secure the device 200 to a surface, e.g., a surface disposed adjacent to a concrete form (e.g., a concrete form for which the device 200 is intended to stabilize). The surface may include land disposed adjacent to the concrete form—e.g., the ground surface, which may include dirt, grass, gravel, sand, mud, rock, concrete, asphalt, and so forth. To this end, each of the anchoring posts 230 may include a tapered end 232 structurally configured for penetrating the land and thereby securing the device 200 to the land. In this manner, each of the anchoring posts 230 may further comprise a blunt end 234 opposite the tapered end 232. The blunt end 234 may be structurally configured for being hit with a force sufficient to drive the anchoring post 230 into the land, such as by a hammer, a sledge hammer, a machine, or the like. The blunt end 234 may comprise a substantially flat surface 236. Thus, the anchoring posts 230 may include a stake or the like. In certain implementations, one or more holes are drilled in the surface disposed adjacent to the concrete form, where the anchoring posts 230 are structurally configured for insertion into such holes.

The surface disposed adjacent to the concrete form may also or instead include an object such as a beam or the like. Thus, one or more of the anchoring members 210 and the anchoring posts 230 may be structurally configured for engagement with such an object. For example, one or more of the anchoring members 210 and the anchoring posts 230 may include a clamp, a clip, a latch, a hook, a pin, a screw, a snap, a slider, a tie, or the like.

The device 200 may include one or more sliders 240, e.g., at least two sliders 240. Each of the sliders 240 may include an elongate body 241 sized and shaped for insertion from a first end 242 thereof into the cavity 222 of one of the elongate members 220 (e.g., through an opening 224 of the elongate member 220). In certain implementations that include at least two sliders 240, at least one of the sliders 240 may include a second end 244 affixed to an engagement member 250. For example, each of the sliders 240 may be affixed to the engagement member 250 as shown in the figure. Each of the sliders 240 may be substantially the same size, or the sliders 240 may include different sizes, e.g., different lengths.

The engagement member 250 may include a surface 252 structurally configured for engaging the concrete form, e.g., from an exterior of the concrete form. For example, the surface 252 of the engagement member 250 may include a substantially flat area. The surface 252 of the engagement member 250 may also or instead include one or more apertures 254, e.g., for affixing the engagement member 250 to a surface of the concrete form. For example, in certain implementations, the engagement member 250 may be structurally configured for affixing to a surface of the concrete form using a screw, a nail, a bolt, or the like.

The engagement member 250 may be permanently attached to one or more of the sliders 240, or the engagement member 250 may be removably attached to one or more of the sliders 240. In certain implementations, the engagement member 250 is adjustable with respect to the sliders 240.

As shown in the figure, in certain implementations, each of the sliders 240 is affixed to a single engagement member 250 such that each of the sliders 240 is disposed away from one another and aligned substantially parallel to one another along the second axis 204. In another implementation, only one of the sliders 240 is affixed to an engagement member. In yet another implementation, each of the sliders 240 is affixed to separate engagement members. In such an embodiment, a first slider may be positionable to a first depth within the cavity 222 of a first elongate member, and a second slider may be positionable to a second depth within the cavity 222 of a second elongate member. The first depth and the second depth may be different depths or substantially equal depths. Thus, each of the sliders 240 may be the same length in implementations, or one or more of the sliders 240 may have different lengths.

In certain implementations, one or more of the sliders 240 may have a length that is substantially equal to a length of one or more of the elongate members 220. In this manner, certain implementations may include two or more sliders 240 that (nearly) completely slide into two or more corresponding elongate members 220. In other implementations, the sliders 240 may be longer than the elongate members 220, such that when a slider 240 is slid within a cavity 222 of an elongate member 220, a portion of the slider 240 remains exposed. To this end, the frame 206 may be located greater distances from a concrete form, while still stabilizing the concrete from, e.g., using relatively long sliders 240.

The device 200 may include one or more retaining members. The retaining members may be structurally configured to allow for adjustment of the device 200, and/or for locking a configuration of the device 200.

The device 200 may include one or more first retaining members 260 on the frame 206. The first retaining members 260 may be structurally configured to engage the anchoring post 230 when the anchoring post 230 is inserted through the channel 212 of the anchoring member 210 thereby maintaining a position of the frame 206 along the first axis 202. In this manner, the position of the frame 206 along the anchoring posts 230 may be adjustable and/or lockable using the first retaining members 260. The position of the frame 206 along the anchoring posts 230 may correlate to a z-axis position of the frame 206, e.g., with respect to the ground or to the concrete form. Thus, the first axis 202 may represent the z-axis.

In certain implementations, the first retaining member 260 may be disposed on one or more of the anchoring members 210. For example, the first retaining member 260 may be insertable into the channel 212 from a side 214 of the anchoring member 210 to engage the anchoring post 230 when the anchoring post 230 is inserted through the channel 212 of the anchoring member 210 thereby maintaining a position of the frame 206 relative to the anchoring post 230 along the first axis 202.

The device 200 may include one or more second retaining members 270. The second retaining members 270 may be structurally configured to engage one or more of the sliders 240 when the sliders 240 are inserted into the elongate member 220 thereby maintaining a position of the sliders 240 along the second axis 204. In this manner, the position of the sliders 240 within the frame 206, and thus the position of the engagement member 250 attached to the sliders 240 with respect to the frame 206, may be adjustable and/or lockable using the second retaining members 270. The position of the sliders 240 within the frame 206 (and/or the position of the engagement member 250 with respect to the frame 206) may correlate to a horizontal position of the sliders 240 or engagement member 250, e.g., with respect to the concrete form. Thus, the second axis 204 may represent a horizontal axis. As stated above, the sliders 240 may be positionable to various depths within the cavities 222 of the elongate members 220, and thus, the second retaining members 270 may be used to maintain desired depths.

In certain implementations, the second retaining members 270 may be disposed on one or more of the elongate members 220. For example, the second retaining members 270 may be insertable into the cavity 222 from a side 226 of the elongate member 220 to engage the slider 240 when the slider 240 is inserted into the elongate member 220 thereby maintaining a position of the slider 240 along the second axis 204.

One or more of the first retaining members 260 and the second retaining members 270 may include one or more of a pin, a screw, and a bolt. In this manner, the first retaining members 260 and the second retaining members 270 may be insertable into holes 238, 246 provided on the anchoring posts 230 or sliders 240 (as explained below), or the first retaining members 260 and the second retaining members 270 may simply apply a force to the anchoring posts 230 or sliders 240 to maintain a position thereof. One or more of the first retaining members 260 and the second retaining members 270 may also or instead include a cam lock or the like. Thus, one or more of the first retaining members 260 and the second retaining members 270 may be lockable.

In certain implementations, the anchoring post 230 may include a number of holes 238, where the first retaining member 260 is insertable into the channel 212 from the side 214 of the anchoring member 210 and into one of the number of holes 238. The anchoring member 210 may similarly include one or more cooperating holes 216 on its side 214, e.g., a plurality of holes 216 up and down a length of its side 214 to align with the holes 238 of the anchoring post 230. In some implementations, the first retaining member 260 may include a cotter pin or the like. The first retaining member 260 may also or instead be spring-loaded.

In certain implementations, the slider 240 may comprise a number of holes 246, where the second retaining member 270 is insertable into the cavity 222 from the side 226 of the elongate member 220 and into one of the number of holes 246. The elongate member 220 may similarly include cooperating holes 228 on its side 226, e.g., across a length of its side 226 to align with the holes 246 of the slider 240. In some implementations, the second retaining member 270 may include a cotter pin or the like. The second retaining member 270 may also or instead be spring-loaded.

In certain implementations, one or more of the anchoring members 210, the anchoring posts 230, the elongate members 220, and the sliders 240 are substantially cylindrical in shape. One or more of the anchoring members 210, the anchoring posts 230, the elongate members 220, and the sliders 240 may instead include other shapes, such as a substantially polygonal cross-section (e.g., square, rectangle, triangle, pentagonal, hexagonal, or other shape).

The device 200 (or any of the devices described herein), and one or more of the components of the device 200, may be made from metal such as steel (e.g., tube steel such as ¾-inch or ⅝-inch tube steel), aluminum, or the like. The device 200, and one or more of its components, may also or instead be made from other materials such as a plastic, a composite, a ceramic, a wood, and so forth, as well as combinations thereof.

The configuration of the device 200 may allow for adjustability in at least two directions, e.g., along the first axis 202 and along the second axis 204. For example, the device 200 may be adjustable by sliding the frame 206 up and down the anchoring posts 230 along the first axis 202, where a first retaining member 260 is used to lock the device 200 in a desired position along the first axis 202. This configuration may allow for use of the device 200 on relatively tall concrete forms. The device 200 may also or instead be adjustable by sliding the sliders 240 within the elongate members 220 to a desired depth thereby positioning the engagement member 250 along the second axis 204, where the second retaining members 270 are used to lock the device 200 in a desired position along the second axis 204.

The device 200 may include one or more of the following advantages over prior art forms/stabilizers/kickers. The device 200 may provide a sufficient stability such that a concrete form doesn't move when it is set in place and it is subject to predetermined forces (e.g., forces exerted on a concrete form by the weight of poured concrete). The device 200 may allow for easy set up and adjustability for a user. The device 200 may provide a cost savings relative to prior art kickers, e.g., because the device 200 may be reusable.

Figure 3:
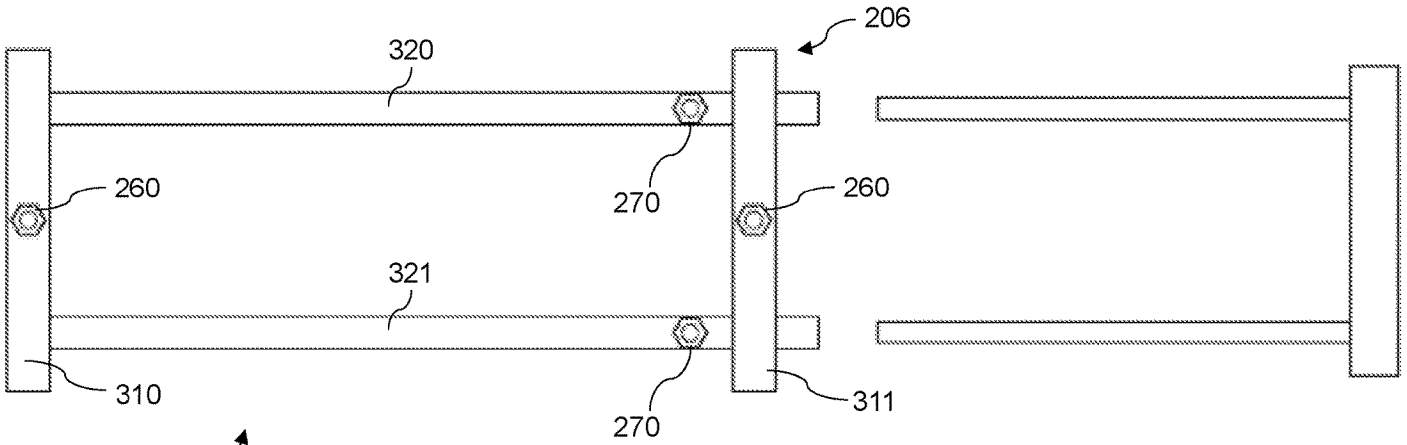
FIG. 3 illustrates a front view of a device for stabilizing a concrete form, in accordance with a representative embodiment.

FIG. 3 illustrates a front view of a device for stabilizing a concrete form, in accordance with a representative embodiment. The device 200 may be the same as that shown and described with reference to FIG. 2 above.

As shown in the figure, the device 200 may include one or more anchoring members—a first anchoring member 310 and a second anchoring member 311. The anchoring members may be structured as shafts that connect elongate members—e.g., a first elongate member 320 and a second elongate member 321. The shafts may be hollow, c-shaped, or otherwise structured to include a channel that forms a pathway for anchoring posts to be inserted therein. As shown in the figure, in an implementation, the first anchoring member 310 may be disposed at or near a first end of the device 200, and the second anchoring member 311 may be disposed at or near a second end of the device 200, where the first end is a terminal portion of the frame 206 of the device 200, and where the second end is a portion of the frame 206 in which the openings of the elongate members are located.

As shown in the figure, in an implementation, a first retaining member 260 may be disposed on each of the first anchoring member 310 and the second anchoring member 311. Alternatively, the first retaining member 260 may be disposed on only one of the first anchoring member 310 and the second anchoring member 311.

As shown in the figure, in an implementation, a second retaining member 270 may be disposed on each of the first elongate member 320 and the second elongate member 321. Alternatively, the second retaining member 270 may be disposed on only one of the first elongate member 320 and the second elongate member 321.

Figure 4:
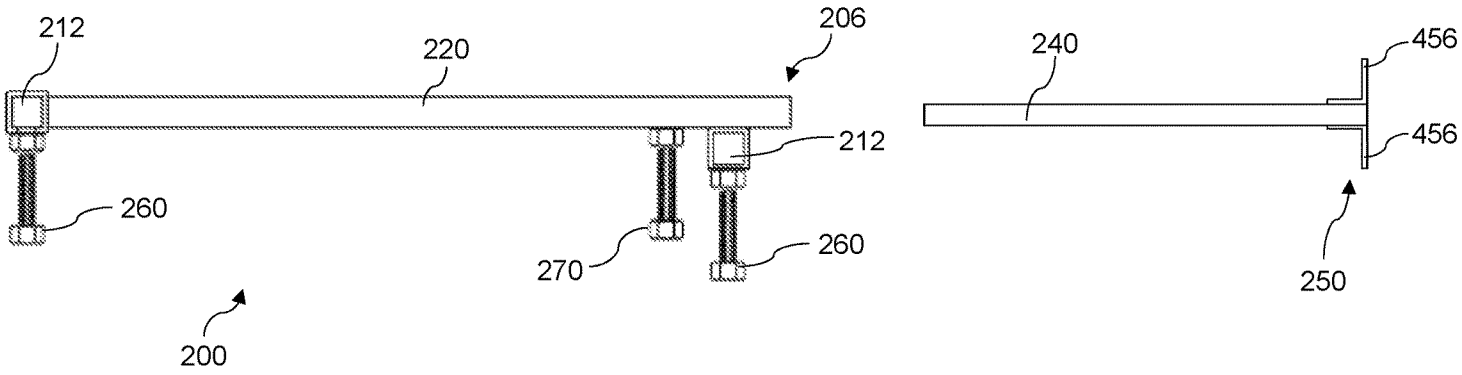
FIG. 4 illustrates a top view of a device for stabilizing a concrete form, in accordance with a representative embodiment.

FIG. 4 illustrates a top view of a device for stabilizing a concrete form, in accordance with a representative embodiment. FIG. 4 shows the channel 212 of the anchoring members formed within the hollow core of shafts that make up the anchoring members.

As shown in the figure, the first retaining members 260 and the second retaining members 270 may include screws, bolts, or the like. The first retaining members 260 may be insertable into the channel 212 for engaging with the anchoring posts thereby locking a position of the frame 206 along the anchoring posts, or otherwise locking a relative position of the anchoring posts and the frame 206. The second retaining members 270 may be insertable into the cavity of the elongate members 220 for engaging with the sliders 240 thereby locking a position of the sliders 240 within the elongate members 220. In this manner, a relative position of the frame 206 and the engagement member 250 may be maintained.

The engagement member 250 may include one or more surfaces structurally configured for engaging a concrete form. For example, the engagement member 250 may include one or more flanges 456. One or more of the flanges 456 may include an aperture for securing the engagement member 250 to the concrete form, e.g., using a screw, a nail, a bolt, or the like inserted through the aperture and into a surface of the concrete form. The flanges 456 may be sized and shaped for engagement with a plurality of sizes and shapes of concrete forms. The flanges 456 may also or instead be used at abutments of surfaces of concrete forms, e.g., in implementations including more than one flange 456 or otherwise having an elongated engagement member 250. In certain implementations, the flanges 456 may be adjustable.

Figure 5:
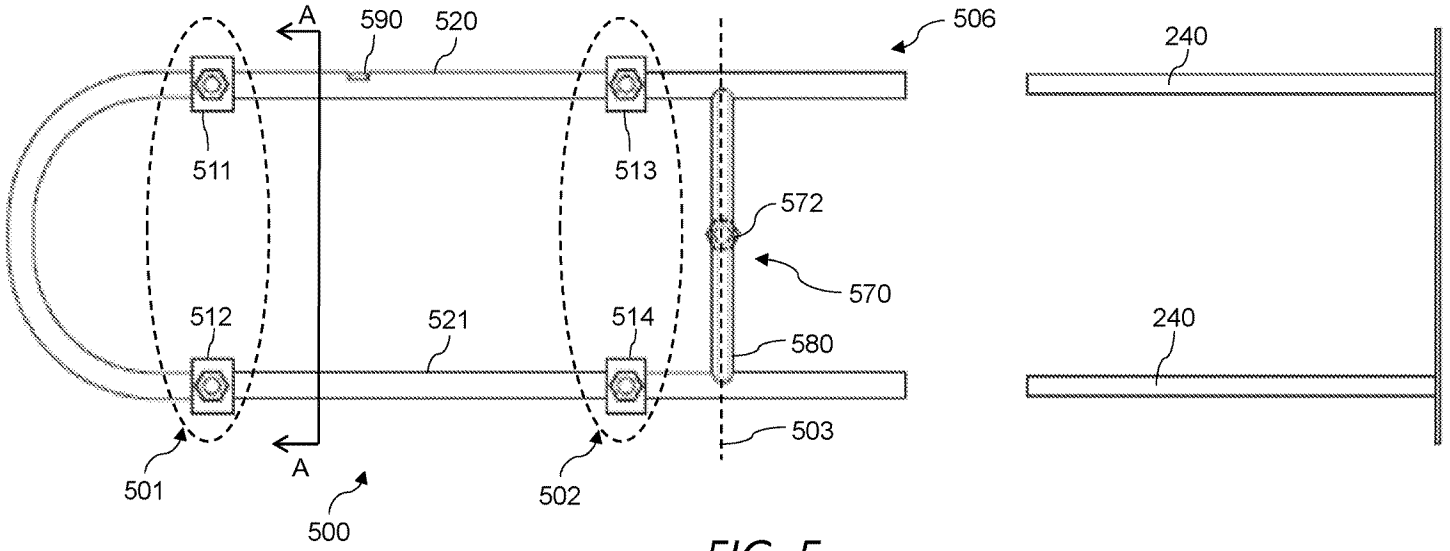
FIG. 5 illustrates a front view of a device for stabilizing a concrete form, in accordance with a representative embodiment.

FIG. 5 illustrates a front view of a device for stabilizing a concrete form, in accordance with a representative embodiment. The device 500 may be similar to those described herein, e.g., with reference to FIGS. 2-4 above, but may include an alternate design for the anchoring members and the second retaining member 570. Further, the device 500 may include a different shape for its frame 506, e.g., one that has less joints and thereby includes less welds than other shapes. To this end, one or more of the portions of the device 500 may be rounded.

The anchoring members of the device 500 shown in the figure may be included in one or more pairs of anchoring members—e.g., a first pair 501 of anchoring members and a second pair 502 of anchoring members. Each of the anchoring members in the first pair 501 and each of the anchoring members in the second pair 502 may be substantially the same, or one or more of the anchoring members may be different. The pathways of the anchoring members included in the pairs of anchoring members may be substantially aligned as explained below.

As shown in the figure, at least two anchoring members may be included in the first pair 501 of anchoring members, where a first anchoring member 511 in the first pair 501 is included on a first elongate member 520 and a second anchoring member 512 in the first pair 501 is included on a second elongate member 521. The channels of the first anchoring member 511 and the second anchoring member 512 may be aligned such that a single anchoring post can be inserted into the channels of each of the first anchoring member 511 and the second anchoring member 512, where the anchoring post can be disposed within the channels of each of the first anchoring member 511 and the second anchoring member 512 simultaneously.

As shown in the figure, at least two anchoring members may be included in the second pair 502 of anchoring members. The second pair 502 of anchoring members may include a third anchoring member 513 and a fourth anchoring member 514. The third anchoring member 513 may be disposed on the first elongate member 520 and the fourth anchoring member 514 may be disposed on the second elongate member 521. The channels of the third anchoring member 513 and the fourth anchoring member 514 may be aligned such that a second anchoring post can be inserted into the channels of each of the third anchoring member 513 and the fourth anchoring member 514, where the second anchoring post can be disposed within the channels of each of the third anchoring member 513 and the fourth anchoring member 514 simultaneously.

The device 500 may include a second retaining member 570 that is disposed between the elongate members, e.g., the first elongate member 520 and the second elongate member 521. As shown in the figure, the second retaining member 570 may be disposed at least partially within a shaft 580 that couples the at least two elongate members, e.g., the first elongate member 520 and the second elongate member 521.

At least a portion of the second retaining member 570 may be movable along a first axis 503, e.g., an axis that intersects the cavities of both the first elongate member 520 and the second elongate member 521. In this manner, the movable portion of the second retaining member 570 may be movable (from within the shaft 580) into and out of the cavities of one or more of the first elongate member 520 and the second elongate member 521. To this end, the movable portion of the second retaining member 570 may be movable into and out of engagement with a slider 240 that is inserted into the cavities of one or more of the first elongate member 520 and the second elongate member 521, e.g., for locking the position of the slider 240. Movement of the portion of the second retaining member 570 may be provided by a manual control 572. For example, the movable portion of the second retaining member 570 may include a bar stock or the like that moves in response to the manual control 572, e.g., a turning of the manual control 572. The manual control 572 may include one or more of a screw and a bolt, e.g., that is affixed to a handle (e.g., a T-handle) or the like for a user to turn with relative ease. The manual control 572 may allow for adjustment using only one hand of a user (e.g., single-handed operation), e.g., through the inclusion of a T-handle or the like. Movement of the portion of the second retaining member 570 may also or instead be provided by another control, e.g., an electrical control (e.g., a solenoid) or the like.

A similar retaining member is described below with reference to FIG. 8.

The device 500 may further include one or more tools 590 that assist in aligning the device 500 on a job site. For example, the one or more tools 590 may include a level, a depth indicator, or the like.

Figure 6:
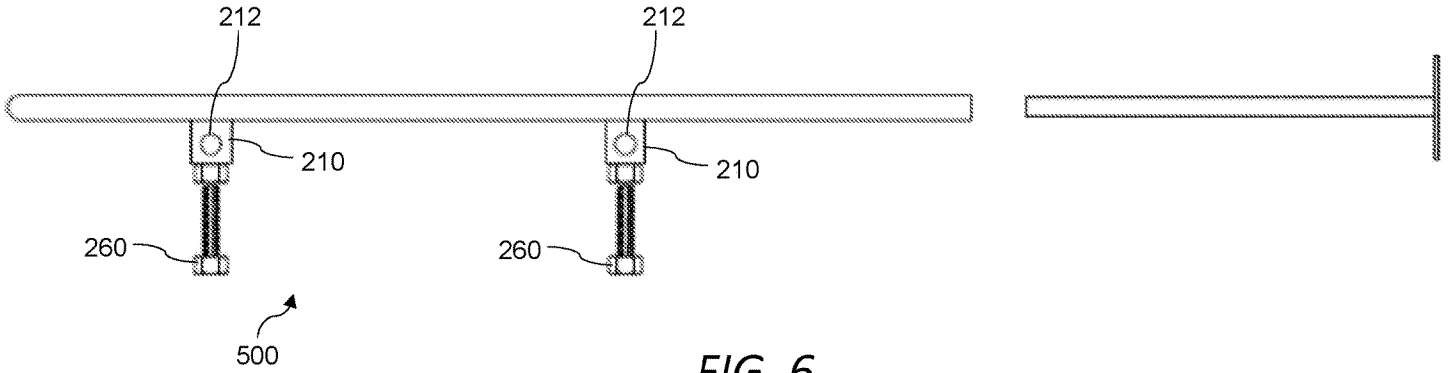
FIG. 6 illustrates a top view of a device for stabilizing a concrete form, in accordance with a representative embodiment.

FIG. 6 illustrates a top view of a device for stabilizing a concrete form, in accordance with a representative embodiment. The device 500 may be the same or similar to that shown in FIG. 5. In FIG. 6, the channels 212 that pass through the anchoring members 210 are clearly visible. As shown in the figure, the first retaining members 260 may include screws, bolts, or the like. One or more of the anchoring members 210 may include corresponding first retaining members 260.

Figure 7:
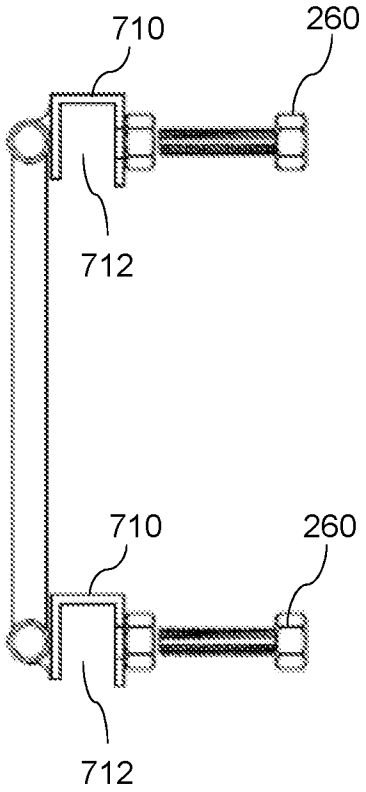
FIG. 7 illustrates a cross-sectional view through Section A-A of FIG. 5, in accordance with a representative embodiment.

FIG. 7 illustrates a cross-sectional view through Section A-A of FIG. 5, in accordance with a representative embodiment. As shown in the figure, in implementations, the channels 712 of the anchoring members 710 may include c-channels or the like. The channels may also or instead include an enclosed cavity or shaft. In certain implementations, the first retaining members 260 may be insertable into the channels 712 via screwing or pushing.

Figure 9:
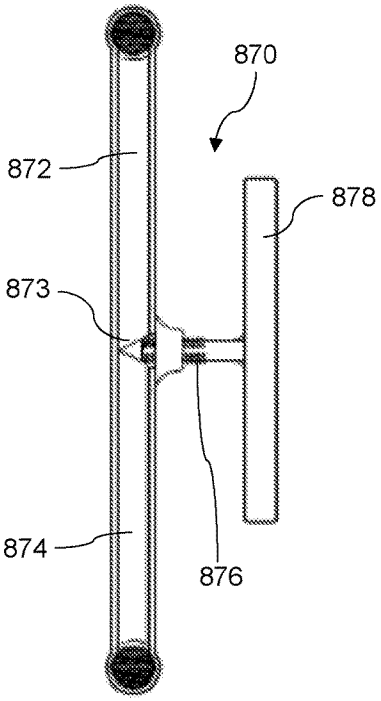
FIG. 9 illustrates a cross-sectional view of the retaining member of FIG. 8, in accordance with a representative embodiment.
Figure 8:
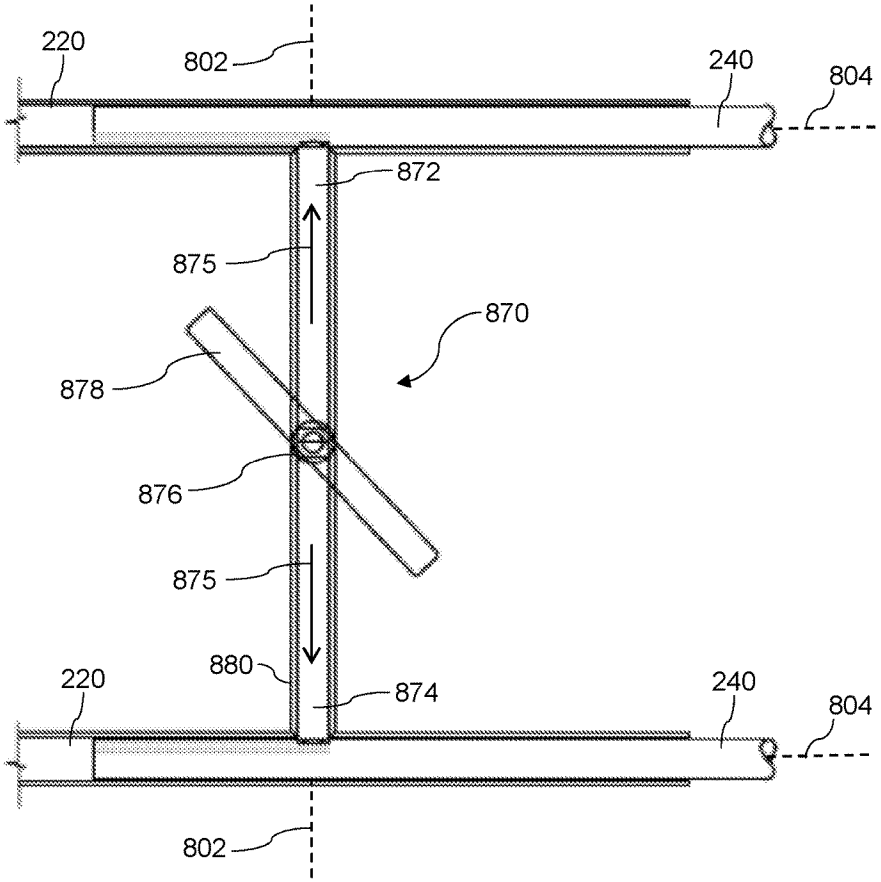
FIG. 8 illustrates a retaining member, in accordance with a representative embodiment.

FIG. 8 illustrates a retaining member, in accordance with a representative embodiment. FIG. 9 illustrates a cross-sectional view of the retaining member of FIG. 8, in accordance with a representative embodiment. In FIGS. 8 and 9, the retaining member may include the second retaining member 870 as described herein. The second retaining member 870 may be structurally configured to engage one or more sliders 240 when the sliders 240 are inserted into elongate members 220 of a device for stabilizing a concrete form. The second retaining member 870 may thereby act to maintain a position of the sliders 240 along an insertion axis 804.

The second retaining member 870 may be disposed between at least two elongate members 220, and more specifically, the second retaining member 870 may be disposed at least partially within a shaft 880 that couples the elongate members 220.

At least a portion of the second retaining member 870 may movable within the shaft 880 along a locking axis 802. In certain aspects, the movable portion of the second retaining member 870 includes one or more bar stocks, e.g., a first bar stock 872 and a second bar stock 874. The bar stocks may include one or more pieces of material that are movable within the shaft 880 along the locking axis 802. The bar stocks may also or instead include a fluid or another component that is movable or pressurizable within the shaft 880. In certain implementations, the bar stocks may include blocks of material (e.g., steel) that have an indention 873 (e.g., an inclined surface) such that movement of a protrusion into the shaft 880 may cause movement of the bar stocks along the locking axis 802, e.g., in the direction of the arrows 875.

Movement of the movable portion of the second retaining member 870 (e.g., the first bar stock 872 and the second bar stock 874) may be provided by a control, e.g., a manual control 876. As shown in the figure, the manual control 876 may include one or more of a screw and a bolt affixed to a handle 878 (e.g., a T-handle). In this manner, a user may turn the handle 878 thereby turning the screw of the manual control 876, which can cause the screw to descend into the shaft 880 or retract from the shaft 880. The movement of the screw (or other protrusion) into or out of the shaft 880 may cause movement of the bar stocks as described above.

Figure 10:
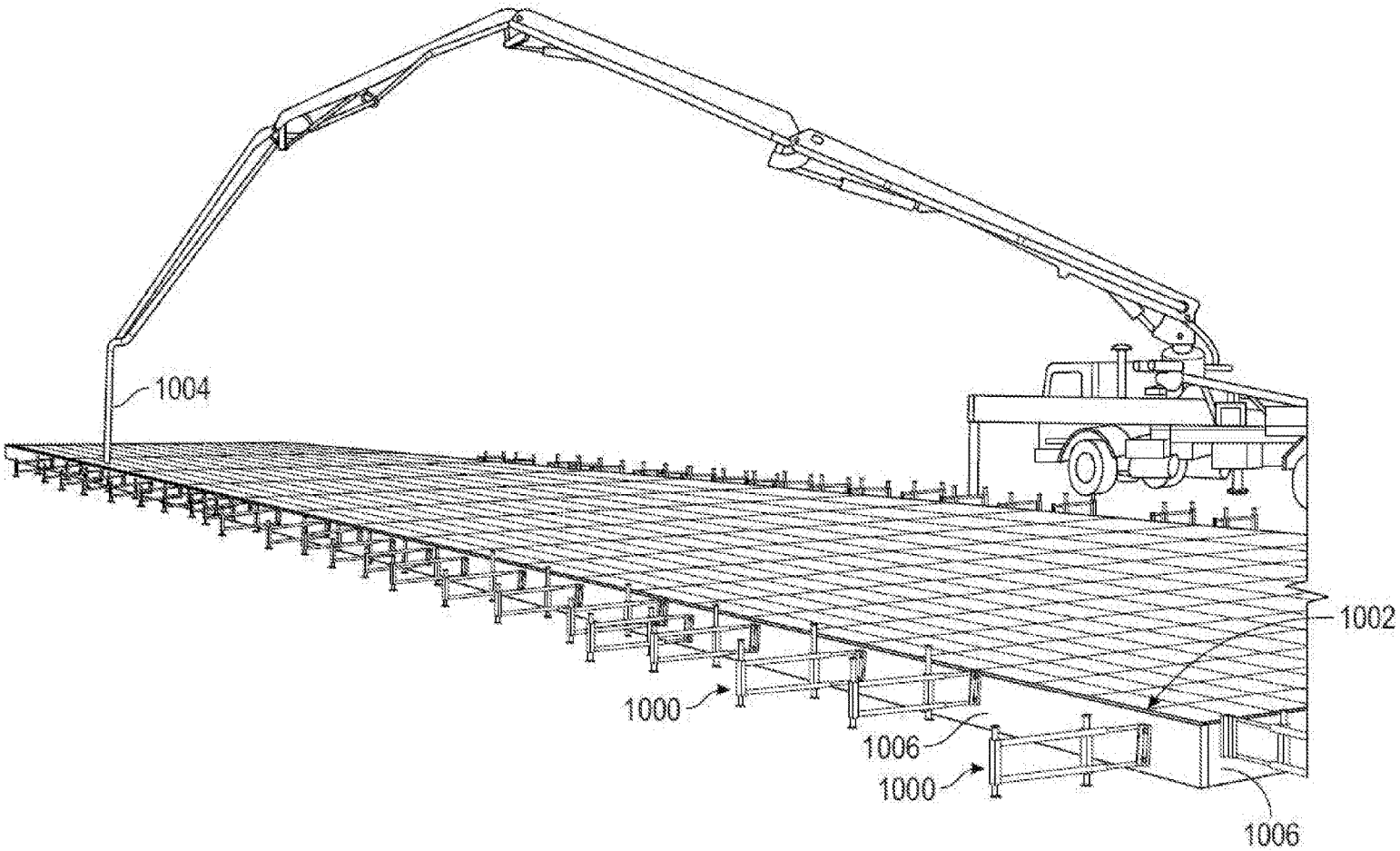
FIGS. 10-12 illustrate a plurality of devices for stabilizing a concrete form in use, in accordance with representative embodiments.
Figure 11:
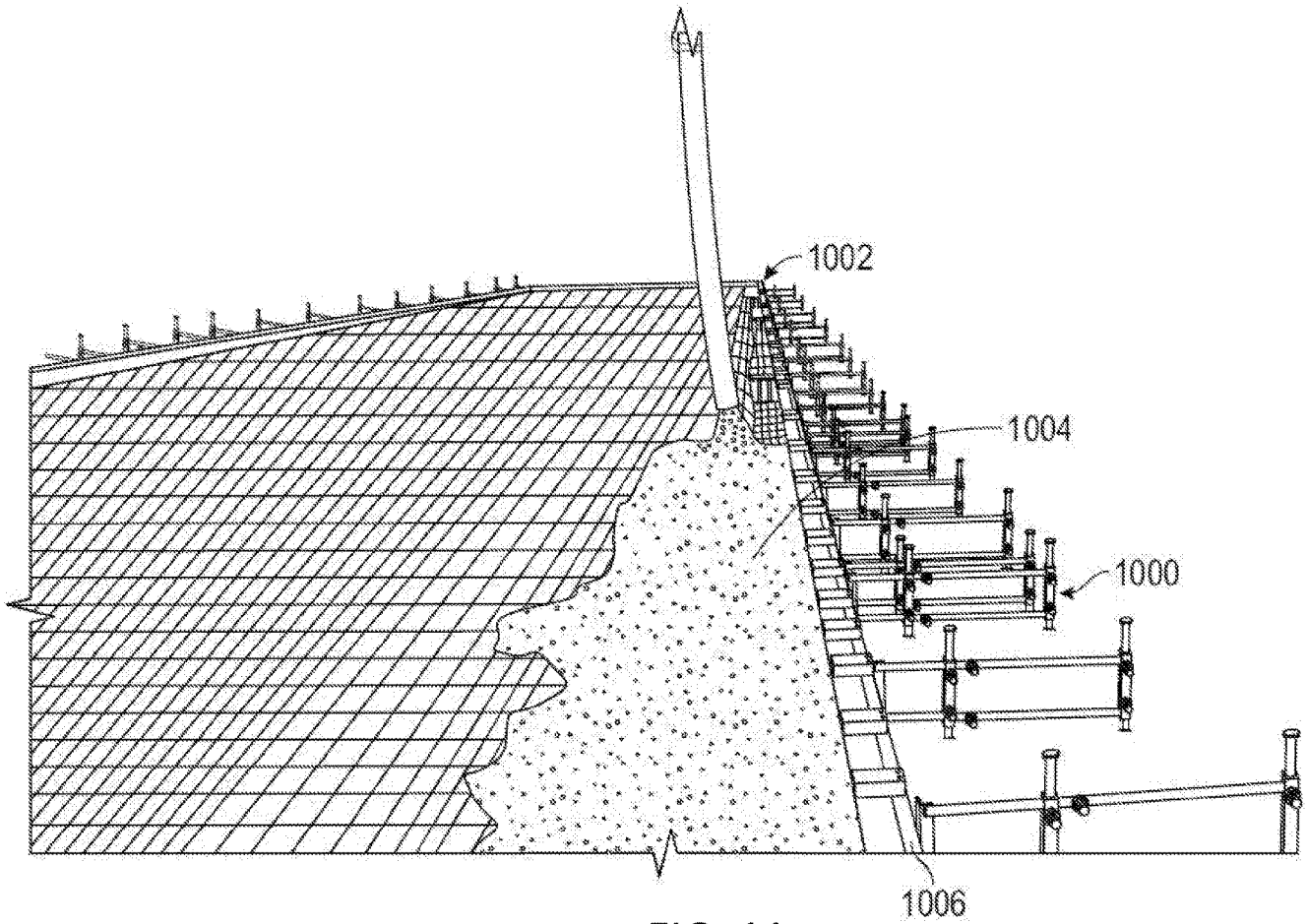
Figure 12:
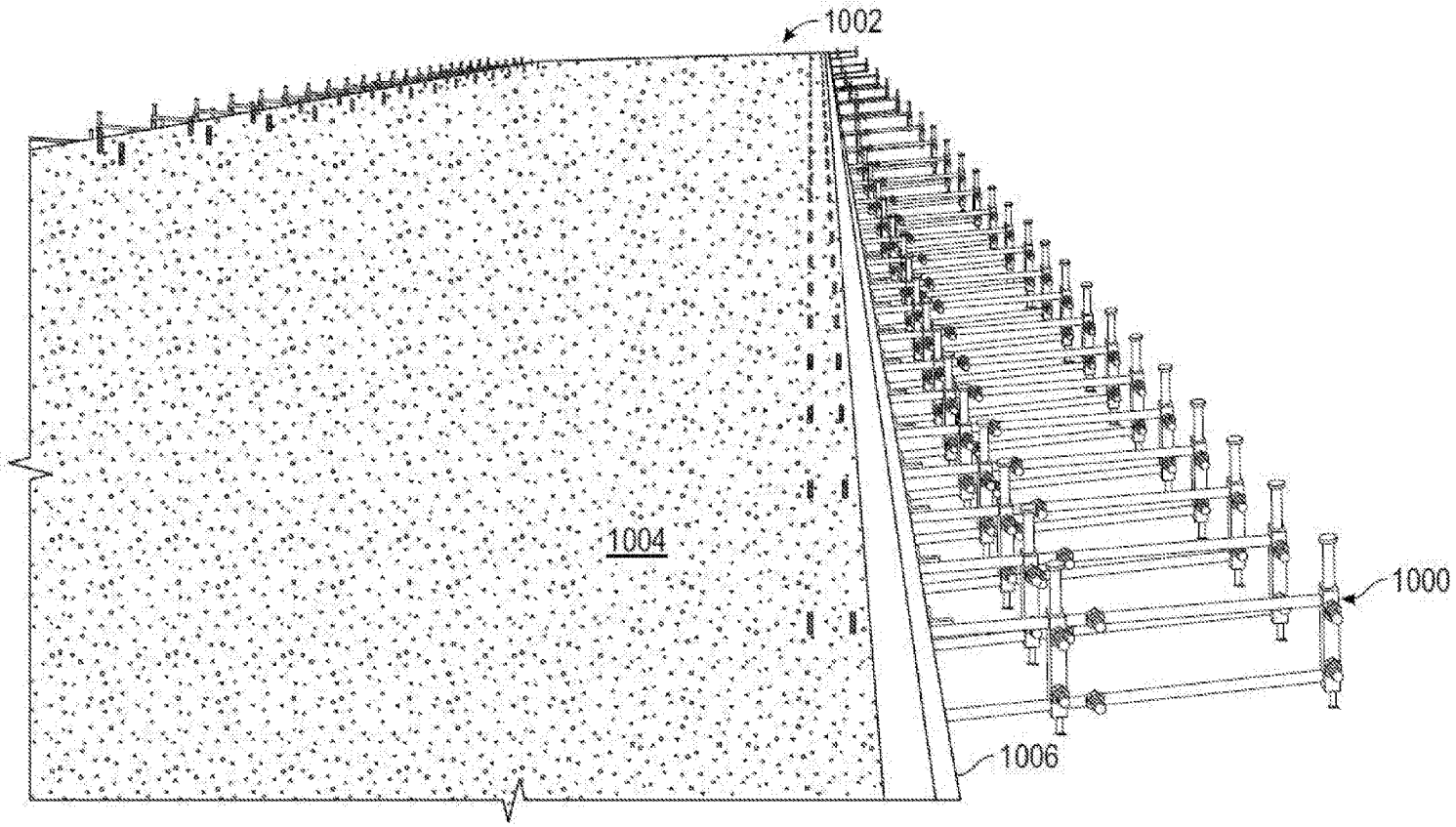

FIGS. 10-12 illustrate a plurality of devices for stabilizing a concrete form in use, in accordance with representative embodiments. The devices 1000 shown in FIGS. 10-12 may include any as described herein.

As shown in FIGS. 10 and 11, the devices 1000 may be used for stabilizing a concrete form 1002, where concrete 1004 is shown being poured into the concrete form 1002 that is being stabilized by a plurality of devices 1000. The concrete form 1002 may include a border within which the concrete 1004 is poured, e.g., to form a concrete slab. The border of the concrete form 1002 may be formed by a plurality of surfaces 1006, e.g., wooden boards, that are stabilized by the devices 1000.

As shown in FIG. 12, the devices 1000 may continue to stabilize the surfaces 1006 of the concrete form 1002 until the concrete 1004 hardens into a desired shape.

Figure 13:
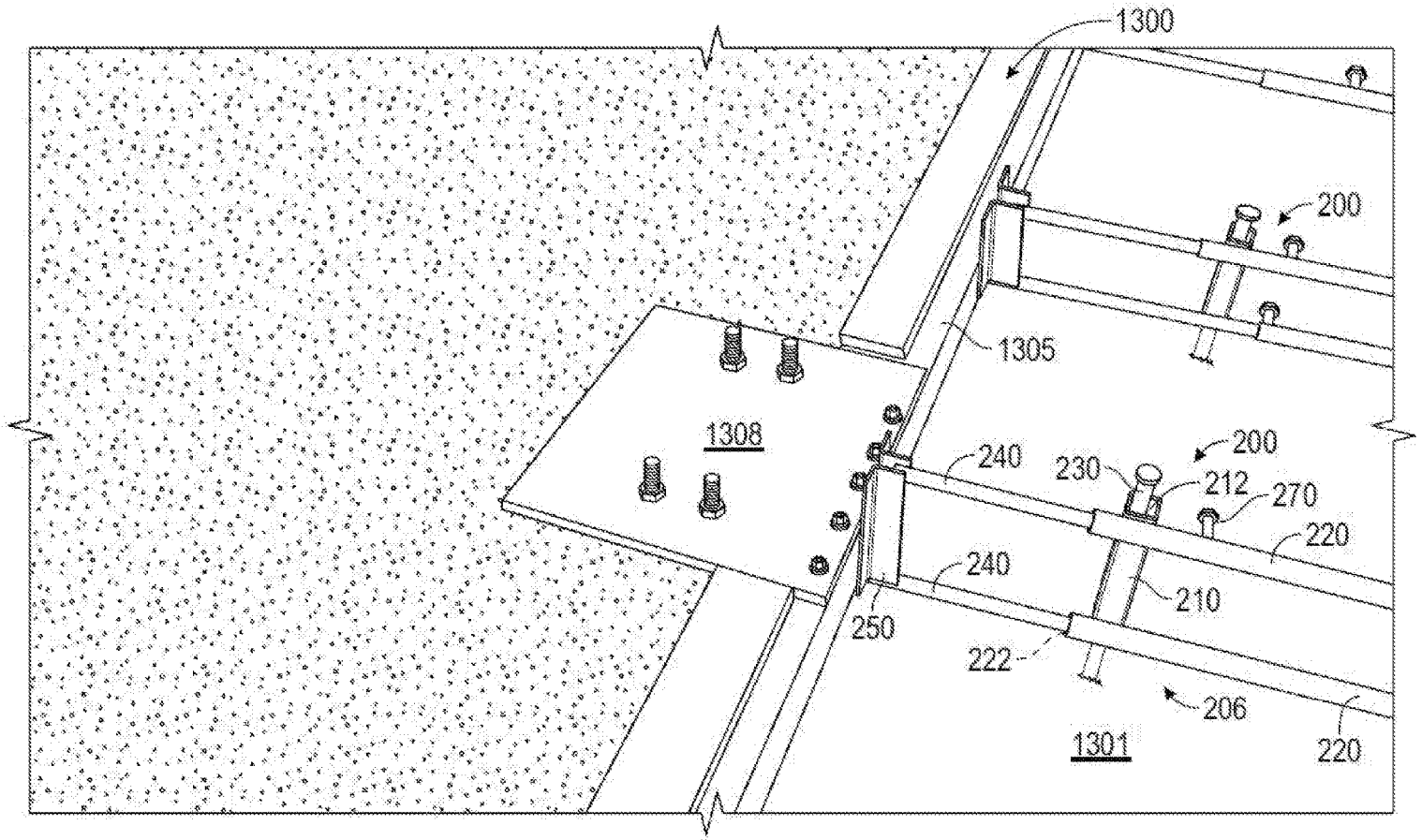
FIG. 13 illustrates a close-up view of a device for stabilizing a concrete form in use, in accordance with a representative embodiment.

FIG. 13 illustrates a close-up view of a device for stabilizing a concrete form in use, in accordance with a representative embodiment. As shown in the figure, the device 200 may stabilize a surface 1305 of a concrete form 1300 at a location of a column 1308 or another structural element. The device 200 may be the same or similar to any as described herein, e.g., with reference to FIG. 2.

FIG. 13 shows the device 200 with an anchoring post 230 inserted within the channel 212 of an anchoring member 210 and into the ground 1301 (although other surfaces are possible for anchoring the device 200). The frame 206 of the device 200 may be locked onto the anchoring post 230 by one or more retaining members (e.g., the first retaining members as described herein, which are not visible in this figure).

The sliders 240 may be inserted within the cavity 222 of elongate members 220, and locked in position within the elongate members 220 by a second retaining member 270 such that the engagement member 250 is engaging a surface 1305 of the concrete form 1300.

In some implementations, anchoring members may be replaced with pathways through the elongate members themselves. In this manner, the sliders may include slots, grooves, holes, or the like, such that an anchoring post can be slid simultaneously through an elongate member and a slider. Instead, the pathways through the elongate members themselves may be disposed on the frame such that the sliders would not reach a depth so as to interfere with a location of the pathway, and therefore would not interfere with an anchoring post.

In an implementation, a method for stabilizing a concrete form includes: inserting an anchoring post through a channel of an anchoring member of a device for stabilizing a concrete form, the channel defining a pathway aligned along a first axis; securing the anchoring post to a surface disposed adjacent to the concrete form; inserting at least two sliders into a cavity disposed within each of at least two elongate members, where the at least two elongate members are coupled to one another thereby forming a frame for the device, where the cavity of one of the at least two elongate members is aligned substantially parallel to the cavity of another one of the at least two elongate members along a second axis intersecting the first axis, where the at least two sliders each comprise an elongate body sized and shaped for insertion from a first end thereof into the cavity of one of the at least two elongate members, where at least one of the at least two sliders comprise a second end affixed to an engagement member, and where the engagement member comprises a surface structurally configured for engaging the concrete form; engaging the anchoring post with the frame using a first retaining member when the anchoring post is inserted through the channel of the anchoring member thereby maintaining a position of the frame along the first axis; engaging the surface of the engagement member to the concrete form; and engaging one or more of the at least two sliders with the frame using a second retaining member when the at least two sliders are inserted into the elongate member thereby maintaining a position of the at least two sliders along the second axis.

Although this disclosure generally references concrete forms, a person skilled in the art will recognize that the devices, systems, and methods described herein may be used for stabilizing other structures or forms. For example, the devices may be used for stabilizing forms for the pouring of another material/substance in addition to or lieu of concrete such as asphalt, tar, concrete alternatives, or the like. The devices may also or instead be used for stabilizing forms outside of the construction industry, such as those used in artistic or fanciful designs, manufacturing, molding, and so forth.

The above systems, devices, methods, processes, and the like may be realized in hardware, software, or any combination of these suitable for a particular application. The hardware may include a general-purpose computer and/or dedicated computing device. This includes realization in one or more microprocessors, microcontrollers, embedded microcontrollers, programmable digital signal processors or other programmable devices or processing circuitry, along with internal and/or external memory. This may also, or instead, include one or more application specific integrated circuits, programmable gate arrays, programmable array logic components, or any other device or devices that may be configured to process electronic signals. It will further be appreciated that a realization of the processes or devices described above may include computer-executable code created using a structured programming language such as C, an object oriented programming language such as C++, or any other high-level or low-level programming language (including assembly languages, hardware description languages, and database programming languages and technologies) that may be stored, compiled or interpreted to run on one of the above devices, as well as heterogeneous combinations of processors, processor architectures, or combinations of different hardware and software. In another implementation, the methods may be embodied in systems that perform the steps thereof, and may be distributed across devices in a number of ways. At the same time, processing may be distributed across devices such as the various systems described above, or all of the functionality may be integrated into a dedicated, standalone device or other hardware. In another implementation, means for performing the steps associated with the processes described above may include any of the hardware and/or software described above. All such permutations and combinations are intended to fall within the scope of the present disclosure.

Embodiments disclosed herein may include computer program products comprising computer-executable code or computer-usable code that, when executing on one or more computing devices, performs any and/or all of the steps thereof. The code may be stored in a non-transitory fashion in a computer memory, which may be a memory from which the program executes (such as random access memory associated with a processor), or a storage device such as a disk drive, flash memory or any other optical, electromagnetic, magnetic, infrared or other device or combination of devices. In another implementation, any of the systems and methods described above may be embodied in any suitable transmission or propagation medium carrying computer-executable code and/or any inputs or outputs from same.

It will be appreciated that the devices, systems, and methods described above are set forth by way of example and not of limitation. Absent an explicit indication to the contrary, the disclosed steps may be modified, supplemented, omitted, and/or re-ordered without departing from the scope of this disclosure. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context.

The method steps of the implementations described herein are intended to include any suitable method of causing such method steps to be performed, consistent with the patentability of the following claims, unless a different meaning is expressly provided or otherwise clear from the context. So for example performing the step of X includes any suitable method for causing another party such as a remote user, a remote processing resource (e.g., a server or cloud computer) or a machine to perform the step of X. Similarly, performing steps X, Y, and Z may include any method of directing or controlling any combination of such other individuals or resources to perform steps X, Y, and Z to obtain the benefit of such steps. Thus method steps of the implementations described herein are intended to include any suitable method of causing one or more other parties or entities to perform the steps, consistent with the patentability of the following claims, unless a different meaning is expressly provided or otherwise clear from the context. Such parties or entities need not be under the direction or control of any other party or entity, and need not be located within a particular jurisdiction.

It should further be appreciated that the methods above are provided by way of example. Absent an explicit indication to the contrary, the disclosed steps may be modified, supplemented, omitted, and/or re-ordered without departing from the scope of this disclosure.

It will be appreciated that the methods and systems described above are set forth by way of example and not of limitation. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context. Thus, while particular embodiments have been shown and described, it will be apparent to those skilled in the art that various changes and modifications in form and details may be made therein without departing from the scope of this disclosure and are intended to form a part of the disclosure as defined by the following claims, which are to be interpreted in the broadest sense allowable by law.

The various representative embodiments, which have been described in detail herein, have been presented by way of example and not by way of limitation. It will be understood by those skilled in the art that various changes may be made in the form and details of the described embodiments resulting in equivalent embodiments that remain within the scope of the appended claims.

What is claimed is:

1. A device for stabilizing a concrete form, comprising:

an anchoring member comprising a channel defining a pathway therethrough aligned along a first axis;

at least two elongate members each comprising a cavity, the at least two elongate members coupled to one another thereby forming a frame for the device, the cavity of one of the at least two elongate members aligned substantially parallel to the cavity of another one of the at least two elongate members along a second axis, the second axis intersecting the first axis;

an anchoring post structurally configured for insertion through the channel of the anchoring member to secure the device to a surface disposed adjacent to the concrete form;

at least two sliders each comprising an elongate body sized and shaped for insertion from a first end thereof into the cavity of one of the at least two elongate members, at least one of the at least two sliders comprising a second end affixed to an engagement member, the engagement member comprising a surface structurally configured for engaging the concrete form;

a first retaining member on the frame, the first retaining member structurally configured to engage the anchoring post when the anchoring post is inserted through the channel of the anchoring member thereby maintaining a position of the frame along the first axis; and a second retaining member structurally configured to engage one or more of the at least two sliders when the at least two sliders are inserted into the elongate member thereby maintaining a position of the at least two sliders along the second axis.

2. The device of claim 1, further comprising at least two anchoring members disposed away from one another on the frame with the pathway of each aligned substantially parallel along the first axis.

3. The device of claim 1, further comprising a pair of anchoring members with the pathway of each of the pair of anchoring members substantially aligned.

4. The device of claim 1, where the at least two sliders are each affixed to the engagement member.

5. The device of claim 1, where the anchoring post comprises a tapered end.

6. The device of claim 1, where each of the at least two sliders is affixed to separate engagement members.

7. The device of claim 1, where the surface of the engagement member comprises one or more flanges.

8. The device of claim 7, where at least one of the one or more flanges comprises an aperture.

9. The device of claim 1, where a first one of the at least two sliders is positionable to a first depth within the cavity of a first one of the at least two elongate members, and where a second one of the at least two sliders is positionable to a second depth within the cavity of a second one of the at least two elongate members.

10. The device of claim 9, where the first depth and the second depth are different depths.

11. The device of claim 10, where the first depth and the second depth are substantially equal depths.

12. The device of claim 1, where the second retaining member is disposed on one or more of the at least two elongate members, the second retaining member insertable into the cavity from a side of the elongate member to engage the slider when the slider is inserted into the elongate member thereby maintaining a position of the slider along the second axis.

13. The device of claim 12, where the second retaining member comprises one or more of a pin, a screw, and a bolt.

14. The device of claim 12, where one or more of the at least two sliders comprises a number of holes, and where the second retaining member is insertable into the cavity from the side of the elongate member and into one of the number of holes.

15. The device of claim 1, where the first retaining member is disposed on the anchoring member and is insertable into the channel from a side of the anchoring member to engage the anchoring post when the anchoring post is inserted through the channel.

16. The device of claim 15, where the anchoring post comprises a number of holes, and where the first retaining member is insertable into the channel from the side of the anchoring member and into one of the number of holes.

17. The device of claim 15, where the first retaining member comprises one or more of a pin, a screw, and a bolt.

18. The device of claim 1, where the second retaining member is disposed between the at least two elongate members.

19. The device of claim 18, where the second retaining member is disposed at least partially within a shaft that couples the at least two elongate members.

20. The device of claim 18, where at least a portion of the second retaining member is movable along the first axis.

21. The device of claim 20, where movement of the portion of the second retaining member is provided by a manual control.

22. The device of claim 21, where the manual control comprises one or more of a screw and a bolt.

23. The device of claim 22, where one or more of the screw and the bolt is affixed to a handle.

24. A device for stabilizing a concrete form, comprising:

at least two anchoring members each comprising a channel defining a pathway therethrough aligned along a first axis, the at least two anchoring members disposed away from one another and aligned substantially parallel to one another along the first axis;

at least two elongate members each comprising a cavity, at least one of the at least two elongate members attached to at least one of the at least two anchoring members, and the at least two elongate members coupled to one another thereby forming a frame for the device, the cavity of one of the at least two elongate members aligned substantially parallel to the cavity of another one of the at least two elongate members along a second axis, with the second axis intersecting the first axis;

an anchoring post structurally configured for insertion through the channel of one of the at least two anchoring members to secure the device to a surface disposed adjacent to the concrete form;

at least two sliders each comprising an elongate body sized and shaped for insertion from a first end thereof into the cavity of one of the at least two elongate members, the at least two sliders each comprising a second end affixed to an engagement member, the engagement member comprising a surface structurally configured for engaging the concrete form;

a first retaining member disposed on one or more of the at least two anchoring members, the first retaining member insertable into the channel from a side of the anchoring member to engage the anchoring post when the anchoring post is inserted through the anchoring member thereby maintaining a position of the anchoring post along the first axis; and a second retaining member structurally configured to engage one or more of the at least two sliders when the at least two sliders are inserted into the elongate member thereby maintaining a position of the at least two sliders along the second axis.

25. The device of claim 24, where each of the at least two anchoring members comprise a shaft attached to each of a first elongate member and a second elongate member.

26. The device of claim 24, where the at least two anchoring members are included in a pair of anchoring members, where a first anchoring member is included on a first elongate member and a second anchoring member is included on a second elongate member, and where the channels of the first anchoring member and the second anchoring member are aligned such that the anchoring post can be inserted into the channels of each of the first anchoring member and the second anchoring member.

27. The device of claim 26, further comprising a second pair of anchoring members comprising a third anchoring member and a fourth anchoring member, the third anchoring member disposed on the first elongate member and the fourth anchoring member disposed on the second elongate member, where the channels of the third anchoring member and the fourth anchoring member are aligned such that a second anchoring post can be inserted into the channels of each of the third anchoring member and the fourth anchoring member.

28. A method for stabilizing a concrete form, comprising:

inserting an anchoring post through a channel of an anchoring member of a device for stabilizing a concrete form, the channel defining a pathway aligned along a first axis;

securing the anchoring post to a surface disposed adjacent to the concrete form;

inserting at least two sliders into a cavity disposed within each of at least two elongate members, where the at least two elongate members are coupled to one another thereby forming a frame for the device, where the cavity of one of the at least two elongate members is aligned substantially parallel to the cavity of another one of the at least two elongate members along a second axis intersecting the first axis, where the at least two sliders each comprise an elongate body sized and shaped for insertion from a first end thereof into the cavity of one of the at least two elongate members, where at least one of the at least two sliders comprise a second end affixed to an engagement member, and where the engagement member comprises a surface structurally configured for engaging the concrete form;

engaging the anchoring post with the frame using a first retaining member when the anchoring post is inserted through the channel of the anchoring member thereby maintaining a position of the frame along the first axis;

engaging the surface of the engagement member to the concrete form; and engaging one or more of the at least two sliders with the frame using a second retaining member when the at least two sliders are inserted into the elongate member thereby maintaining a position of the at least two sliders along the second axis.

* * * * *